United States Patent [19]

Heid

[11] Patent Number: 4,874,146

[45] Date of Patent: Oct. 17, 1989

[54] STEERABLE KITE

[76] Inventor: Edmund Heid, Togostrasse 72, D-1000 Berlin 65, Fed. Rep. of Germany

[21] Appl. No.: 256,679

[22] Filed: Sep. 19, 1988

[30] Foreign Application Priority Data

Sep. 18, 1987 [DE] Fed. Rep. of Germany ..... 87126133[U]

[51] Int. Cl.[4] ..... B64C 31/06

[52] U.S. Cl. ..... 244/153 R

[58] Field of Search ..... 244/153 R, 154, 155 R, 244/155 A; D21/88; 446/30, 31

[56] References Cited

U.S. PATENT DOCUMENTS

D 274,827 7/1984 Belloff ..... D21/88
3,920,201 11/1975 Battles ..... 244/153 R
3,963,200 6/1976 Arnstein ..... D21/88

FOREIGN PATENT DOCUMENTS 476507 9/1976 Australia ..... 244/153 R

*Primary Examiner*—Joseph F. Peters, Jr.
*Assistant Examiner*—Anne Sartelle
*Attorney, Agent, or Firm*—Keil & Weinkauf

[57] ABSTRACT

A steerable kite is disclosed that has lateral members, a cross-strut, a covering and a kite controlling apparatus. The lateral members are secured to each other at adjacent ends, and the cross-strut's opposing ends are each attached to a lateral member. The kite controlling apparatus is fastened at the connecting points of the lateral members and the cross-strut and lateral members. This arrangement of elements provides a kite with a single-chamber system that is operationally stable at various wind intensities.

11 Claims, 1 Drawing Sheet

STEERABLE KITE

The present invention relates to a steerable kite, the framework of which consists of two lateral rods and one cross-strut and which is suitable for low to high wind intensities.

The framework of conventional steerable kites consists of two lateral rods, one cross-strut and one keel tube. The legs of the two balance strings required for the steering are fastened at the lateral rods and the keel tube. By means of the central bar (keel), the kite area is divided into two chambers. Under certain circumstances, this may result in an uneven distribution of pressure. When, for the steering, only one of the two balance strings (left or right) is operated, the respective corresponding half of the steerable kite is drawn near which has the result that, because of the two-chamber system, the air current is intensified in the other half of the kite, and when the selected steering position is maintained (right or left) circular motions are generated.

When both balance strings are simultaneously held at the same length, the kite moves into the direction indicated by its tip.

Because two of the four fastening points of the two balance strings are arranged on the keel tube, instabilities occur at higher wind intensities because of the high pressure affecting the keel tube which may result in a bending of this central bar and finally in a tilting of the steerable kite. At the same time, a braking effect is caused by the keel tube.

As a result of its construction, a conventional steerable kite, on the whole, is therefore somewhat difficult to steer because of the existence of an uneven distribution of pressure caused by the two-chamber system created by the keel tube. In addition, conventional steerable kites are suitable only for certain (average) speeds: The downward limit (low wind intensities) is determined by their weight; in upward direction (high wind intensities), the instabilities caused by the pressure on the keel tube have a limiting effect.

An echelon of several kites, which are connected behind one another, can therefore not be achieved without problems because of the indicated difficulties.

The present invention is therefore based on the object of changing the kite structure such that the mentioned difficulties, particularly concerning the steering, will no longer occur, and the steerable kite can be used in all wind intensities.

According to the present invention, this object is achieved by using a cross strut as a third structural element in addition to the two lateral rods. The keel tube, which normally is also used, is eliminted. The balance strings required for the controlling the kite are fastened at the stable connecting points of the three structural rods.

Figure 1:
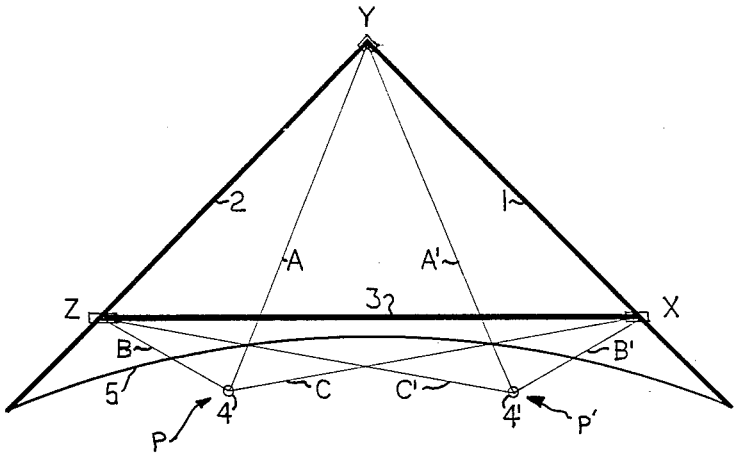
FIG. 1 is a plan view of a preferred embodiment of the present invention.
Figure 2:
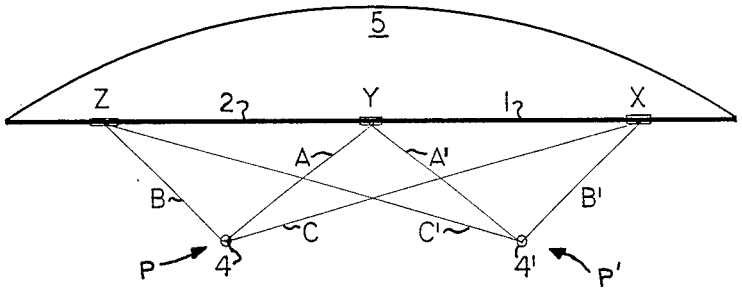
FIG. 2 is a front view of a preferred embodiment of the present invention.

The steerable kite consists of two lateral rods (1) and (2) which are connected with the cross-strut (3). Between the lateral rods, the covering 5" is mounted. As a result, a single-chamber system is created with an optimal air flow profile.

The balance string parts, which are required for the steering, are mounted as follows:

(a) Left Balance String (drawn-out lines)

A fixed string (A,B) is fastened at point (Y) (connection of the two lateral rods (1) and (2)) and at point (Z) (connection of the lateral rod (2) with the cross-strut (3)). In steering point (P), the string (A, B) is then, by means of balance ring (4), connected with the string (C), which is fastened at point (X) (connection of the lateral rod (1) with the cross-strut (3)).

(b) Right Balance String (interrupted lines)

The right balance string is mounted analogously in a mirror-inverted manner, specifically by connecting the fixed string (A', B') (fixed in points (X) and (Y)) with the string (C') (fixed in point (Z)) by means of the balance ring (4') in the steering point (P').

The coverings of the kite may consist of spinnaker nylon. For the making of the lateral rods (1) and (2) as well as for the cross-strut (3), which at the front of the steerable kite is used for the tightening of the sail, different types of round stock, such as fiber glass, carbon fibers, glass filaments or wood may be selected. The length of the cross-strut (3) is variable and should be chosen according to the requirements. It is easily exchangeable in the kite structure.

According to a preferred embodiment of the present invention the steerable kite structure is constructed of two lateral rods (1) and (2) of a length of 82.5 cm and of a diameter of 7 mm as well as of an also 82.5 cm long cross-strut (3) of a diameter of 7.9 mm. As the round stock, glass filament is selected.

A PE-hose is used as the connecting piece between the lateral rods (1) and (2). The cross-strut (3) is connected with the lateral rod (1) or (2), at a height of 21 cm, measured from the end point of the lateral rods, by means of a 6 cm long PE-hose. A fixed string (A, B) or (A', B'), by means of the balance ring (4) or (4'), is connected with a 62 cm long string (C) or (C') in the steering point (P) or P') in such a manner that the length of the string portion (A) or (A') amounts to 60 cm and that of the portion (B) or (B') amounts to 30 cm.

The advantage of the steerable kite according to the present invention is the fact that, because of the nonexistent central bar (keel), a uniform distribution of pressure occurs in the area of the kite (single-chamber system). This makes the kite easier to steer and more stable at higher pressures. In conventional models, for the construction of the two balance strings, four fastenings are required for the individual string portions (A, B, C) or (A', B', C'), of which two are applied to the keel tube and may bend it in the case of higher wind intensities. Whereas, in the kite according to the present invention, only three fastenings are required for this purpose. These are located in the stable connecting points of the three structural rods (1), (2), and (3). As a result, the danger of a bending at higher pressures and the resulting tilting of the kite are eliminated.

The braking effect caused by the keel tube is also eliminated. In addition, the kite's overall weight is reduced. The kite of the present invention may also be used in low as well as high wind intensities.

As a result of the achieved advantages of a simply constructed steerable kite according to the present invention, it is possible for anyone to fly, without any problems, an echelon of ten or more kites connected one behind another.

I claim:

1. A steerable kite, comprising:

(a) first and second lateral members secured at adjacent ends;

(b) a cross-strut extending from the first lateral member to the second lateral member;

(c) a kite covering located between the lateral members;

(d) first and second sets of strings for controlling the kite, wherein each set has strings fastened to at least three general points on the kite, the points comprising:

(i) where the adjacent ends of the lateral members meet, (ii) where the cross-strut meets the first lateral member, and (iii) where the cross-strut meets the second lateral member.

2. The steerable kite of claim 1, wherein the first set of strings comprises:

(a) a first string fastened at a first end near point (i) and at a second end near point (ii), and (b) a second string attached at a first end near point (iii) and at a second end to the first string; and the second set of strings comprises:

(a) a first string fastened at a first end near point (i) and at a second end near point (iii), (b) a second string attached at a first end near point (ii) and at a second end to the first string.

3. A steerable kite, comprising:

(a) first and second lateral members attached to each other at adjacent ends;

(b) a cross-strut extending from the first lateral member to the second lateral member;

(c) a kite covering secured to the kite and covering a region located between the first and second lateral members supports; and (d) first and second kite control means for controlling the kite, each control means having strings attached to the first lateral member, the second lateral member, and where the first and second lateral members meet.

4. A steerable kite, comprising:

(a) first and second lateral members secured to each other at adjacent ends;

(b) a cross-member secured at a first end to the first lateral member and at a second end to the second lateral member;

(c) a means for covering a region located between the first lateral member and the second lateral member; and (d) a means for controlling the kite;

wherein the lateral members, the cross-member, and the covering means form a single chamber system.

5. The steerable kite of claim 3, wherein the first and second kite control means have first and second steering points respectively, a first steering point located on a first string arrangement of the first kite control means and a second steering point located on a second string arrangement of the second kite control means.

6. The steerable kite of claim 5, further comprising first and second balance rings located at the first and second steering points respectfully.

7. The steerable kite of claim 3, wherein a first PE-hose is used to attach the adjacent ends of the first and second lateral members, and wherein the cross-strut is secured to the first and second lateral members by a second and third PE-hose respectively.

8. The steerable kite of claim 4, wherein the means for controlling the kite has strings that attach to the kite at the following locations:

(i) where the first and second lateral members are secured to each other;

(ii) where the cross-member is secured to the first lateral member; and (iii) where the cross-member is secured to the second lateral member.

9. The steerable kite of claim 8, wherein the means for controlling the kite has at least two string arrangments, wherein the two string arrangements are each secured to the kite at locations (i), (ii) and (iii).

10. The steerable kite of claim 9, wherein the means for controlling the kite has two steering points, a first steering point located on the first string arrangement and a second steering point located on the second string arrangement.

11. The steerable kite of claim 10, further comprising first and second balance rings, a first balance ring located at the first steering point and a second balance ring located at the second steering point.

* * * * *